US007982400B2

(12) United States Patent
Kostrun et al.

(10) Patent No.: US 7,982,400 B2
(45) Date of Patent: Jul. 19, 2011

(54) STARTING AID FOR HID LAMP

(76) Inventors: Marijan Kostrun, Tolland, CT (US); Helmar Adler, Danvers, MA (US)

( * ) Notice: Subject to any disclaimer, the term of this patent is extended or adjusted under 35 U.S.C. 154(b) by 66 days.

(21) Appl. No.: 12/146,485

(22) Filed: Jun. 26, 2008

(65) Prior Publication Data

US 2009/0322225 A1 Dec. 31, 2009

(51) Int. Cl.
*H01J 61/073* (2006.01)
*H01J 61/30* (2006.01)

(52) U.S. Cl. ..... 313/634; 313/643; 313/573; 313/631; 313/607; 313/234

(58) Field of Classification Search ..... 313/643, 313/573, 594, 631, 634, 637–642, 234, 607
See application file for complete search history.

(56) References Cited

U.S. PATENT DOCUMENTS

| | | | | |
|---|---|---|---|---|
| 3,714,494 | A | 1/1973 | Nakamura | |
| 3,715,622 | A | 2/1973 | Page et al. | |
| 4,010,397 | A * | 3/1977 | Hon | 315/57 |
| 4,191,910 | A * | 3/1980 | Larson | 315/51 |
| 4,322,658 | A | 3/1982 | Minarczyk | |
| 4,328,445 | A | 5/1982 | Van Den Plas et al. | |
| 4,445,073 | A | 4/1984 | Wyner et al. | |
| 5,323,091 | A * | 6/1994 | Morris | 315/344 |
| 5,355,053 | A | 10/1994 | Zhu | |
| 5,550,421 | A | 8/1996 | Scholz et al. | |
| 5,955,845 | A * | 9/1999 | Fellows | 315/189 |
| 5,959,404 | A | 9/1999 | Nortrup et al. | |
| 6,198,223 | B1 * | 3/2001 | Scholz | 313/623 |
| 6,201,348 | B1 | 3/2001 | Nortrup et al. | |
| 6,222,320 | B1 | 4/2001 | Stockwald | |
| 6,268,698 | B1 | 7/2001 | Scholz | |
| 6,741,034 | B2 | 5/2004 | Scholz | |
| 6,906,462 | B1 | 6/2005 | Gorille | |
| 6,982,526 | B2 | 1/2006 | Schallmoser | |
| 7,038,383 | B2 | 5/2006 | Butler et al. | |
| 7,187,131 | B2 | 3/2007 | Budinger | |
| 2002/0158580 | A1 * | 10/2002 | Uemura et al. | 313/643 |
| 2009/0322224 | A1 | 12/2009 | Kostrun et al. | |

* cited by examiner

*Primary Examiner* — Joseph L Williams
*Assistant Examiner* — Nathaniel J Lee

(57) ABSTRACT

A high-intensity discharge lamp includes a discharge vessel made of an insulator, and a cathode and anode. A V-shaped gap is provided between the anode and a first region of the vessel directly adjacent to where the anode separates from an interior surface of the vessel. A secondary cathode is provided on an exterior surface of the vessel at the first region, where the secondary cathode is positioned so that the V-shaped gap and the first region are between the secondary cathode and the anode. An electric field at the first region produces a dielectric barrier discharge (DBD) which generates ultraviolet (UV) and vacuum ultraviolet VUV photons that impinge on the cathode and initiate a breakdown between the cathode and anode.

10 Claims, 2 Drawing Sheets

STARTING AID FOR HID LAMP

BACKGROUND OF THE INVENTION

The present invention is directed to high-intensity discharge (HID) lamps and more particularly to an HID lamp with a starting aid.

HID lamps are started with a voltage that is higher than the operating voltage of the lamp and that provides an electric field sufficient to cause a breakdown, in the presence of an avalanche-initiating electron. Some starting aids use ultraviolet (UV) enhancers to assure the presence of the avalanche-initiating electron.

For example, U.S. Pat. No. 5,323,091 to Morris describes a UV starting aid for a metal halide arc discharge lamp that includes a cavity in a press seal of the arc tube, where the cavity includes part of the foil of the electrode seal. A ground plane is provided on the exterior of the press seal. The lamp is energized by charging the foil negative with respect to the ground. An electron leaks from a sharp edge of the foil and initiates a dielectric barrier discharge (DBD) in the cavity. The DBD produces UV and vacuum-UV (VUV) photons, depending on the fill gas and its pressure, which in order to facilitate ignition of the lamp have to reach the cathode in the main vessel. As the photons must travel through the press seal material their utility as a starting aid is diminished due to transmission losses U.S. Pat. No. 6,201,348 to Nortrup et al. describes a starting aid for a metal halide discharge lamp in which an arc discharge tube is positioned inside a hermetically sealed jacket. The jacket contains a gas that aids in starting the discharge in the tube. An outer conductor extends on the outside of the jacket and is connected to one of the leads of the tube. When voltage is applied to the electrodes the presence of the external electrode concentrates the electric field near the adjacent internal electrode. This effect in itself helps the breakdown in the tube, but may also lead to formation of a DBD in the jacket. If the latter is the case then these photons must travel through the wall of the arc discharge tube and reach the cathode in the arc tube. Their effectiveness is greatly reduced because of lack of control over the location where the DBD may occur and its position with respect to the cathode. Additionally, the spectrum of the DBD photons depends strongly on the jacket fill gas and may be strongly absorbed by the gas before it reaches the cathode (typically $N_2$, the DBD spectrum of which is shifted more toward visible light compared to Xe or Ar which contain strong UV and VUV components).

Butler et al. (U.S. Pat. No. 7,083,383) disclose a starting aid comprised of conducting strips embedded in the walls of the discharge space. Its primary purpose is to concentrate the electric field at the cathode to promote electron emission. Additionally, the aid can be viewed as a capacitively coupled external electrode and as such it may produce a DBD. This reference does not disclose formation of the photons or recognize the importance of the insulation and geometry in the production of the photons.

U.S. Pat. No. 7,187,131 to Budinger discloses a starting aid with two loops of wire round the neck of each of the electrodes, where the loops are connected and fed with an ignition pulse. The starting aid extends over the light-emitting part of the lamp, affecting the optical properties of the lamp.

Hon (U.S. Pat. No. 4,010,397) discloses an arrangement for triggering a flash lamp in which a conductive patch is bonded to a portion of the outer surface of the lamp and extended over a part of the high voltage electrode. This patent also does not recognize the importance of the insulation and geometry in formation of the photons.

SUMMARY OF THE INVENTION

An object of the present invention is to provide a novel HID lamp and method for starting the lamp in which a UV starting aid for the lamp avoids the problems of the prior art.

A further object of the present invention is to provide a novel high-intensity discharge lamp and method in which the lamp includes a discharge vessel made of an insulator, and a cathode and anode. A V-shaped gap filled with gas is provided between the anode and a first region of the vessel directly adjacent to where the anode separates from an interior surface of the vessel. A secondary cathode is provided on an exterior surface of the vessel at the first region, where the secondary cathode is positioned so that the V-shaped gap and the first region are between the secondary cathode and the anode. An electric field in the first region sufficient to ionize the gas or eject free electrons from the insulating wall creates a DBD. The UV and VUV photons generated by the DBD impinge on the cathode and initiate a breakdown between the cathode and anode and start the lamp.

These and other objects and advantages of the invention will be apparent to those of skill in the art of the present invention after consideration of the following drawings and description of preferred embodiments.

DETAILED DESCRIPTION OF THE INVENTION

Figure 1:
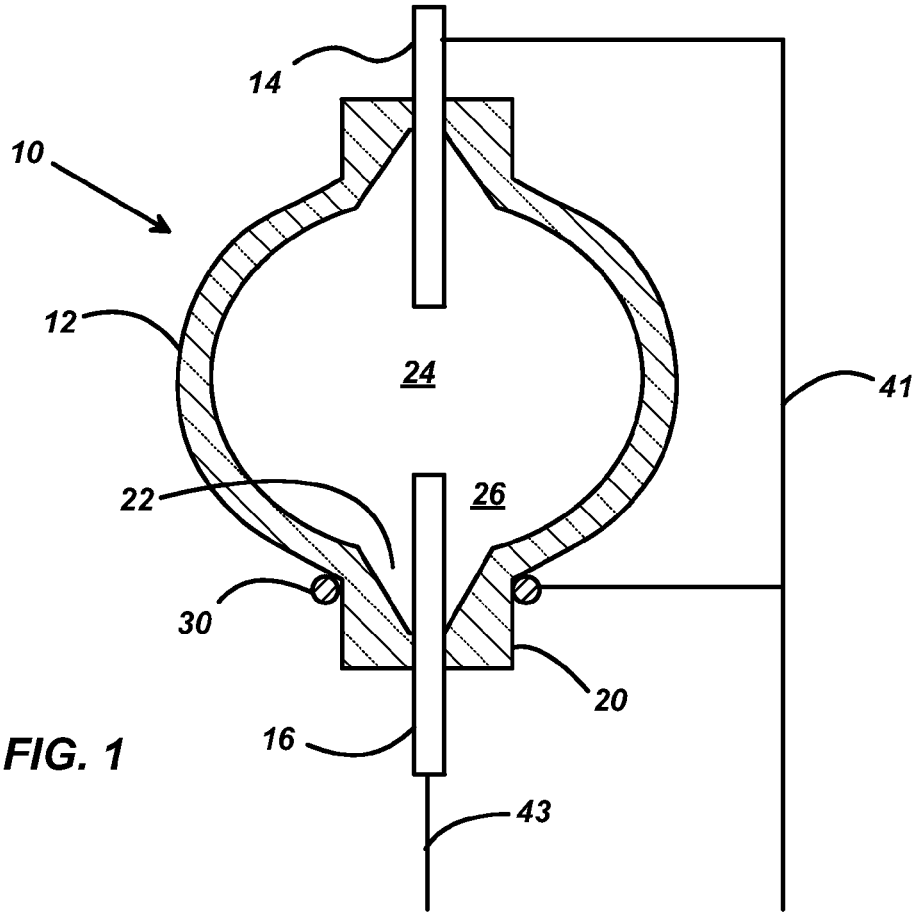
FIG. 1 is a schematic cross-sectional representation of an embodiment of the lamp of the present invention.
Figure 2:
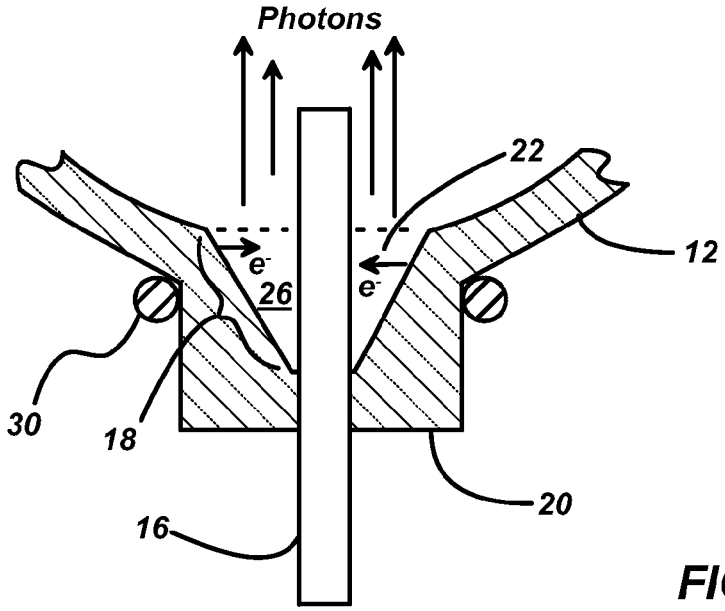
FIG. 2 is a detail of the gap between the anode and secondary cathode of the embodiment of FIG. 1.

With reference now to FIG. 1, a high-intensity discharge (HID) lamp 10 of the present invention includes a discharge vessel 12 made of a solid insulator, and a cathode 14 attached to one end of the vessel and an anode 16 attached to an opposite end of the vessel. As may be seen more clearly in FIG. 2, the vessel 12 has a first region 18 directly adjacent to where the anode 16 separates from an interior surface of the vessel, near the press seal 20 that holds the anode in place. The first region 18 of the vessel and the anode 16 define a V-shaped (triangular) gap 22 between the anode and the interior surface of the vessel. The V-shaped gap opens to a discharge chamber 24 of the vessel and is filled with a gas 26 (the same gas as in the discharge chamber). As is apparent, the V-shaped gap 22 extends around and is rotationally symmetric about the anode 16. The dashed line in FIG. 2 generally demarcates a top of the gap where the interior surface of the vessel 12 turns sharply away from the anode. The first region 18 has an unimpeded line-of-sight to the cathode 14 so that photons emitted from DBD in the V-shaped gap 22 will reach the cathode.

The lamp 10 further includes a secondary cathode 30 on an exterior surface of the vessel at the first region 18 so that the V-shaped gap 22 with the gas 26 and the first region 18 of the solid insulator are between the secondary cathode 30 and the anode 16.

The secondary cathode 30 is connected to the cathode 14 via electrical conductor 41 with circuitry (not shown) suitable for the ignition specifications. Anode 16 is connected to the circuitry via a separate electrical conductor 43. An electric field in the V-shaped gap 22 forms at the first region 18 between the secondary cathode and anode and creates a DBD. The gas 26 is xenon or argon; the DBD in both produces UV and VUV photons via an excimer-molecule decay mechanism. The UV and VUV photons impinge on the cathode 14 to initiate a breakdown between the cathode and the anode, and thereby facilitate ignition of the lamp 10. It is to be noted that the polarities of the electrodes cannot be reversed: a 'secondary anode' will not create the desired DBD as the near-cathode electric field is insufficient to extract an electron in reasonable time.

The duration of the DBD is limited by the motion of ions—once they reach the insulating wall they extinguish the DBD. It has been found that the pulse of photons starts 50-100 ns after applying a voltage to the cathode and may last as long as a few (e.g., 1-5) microseconds. The VUV and UV photons provide the necessary energy needed to eject electrons from the cathode and to help them to ionize the gas.

Figure 3:
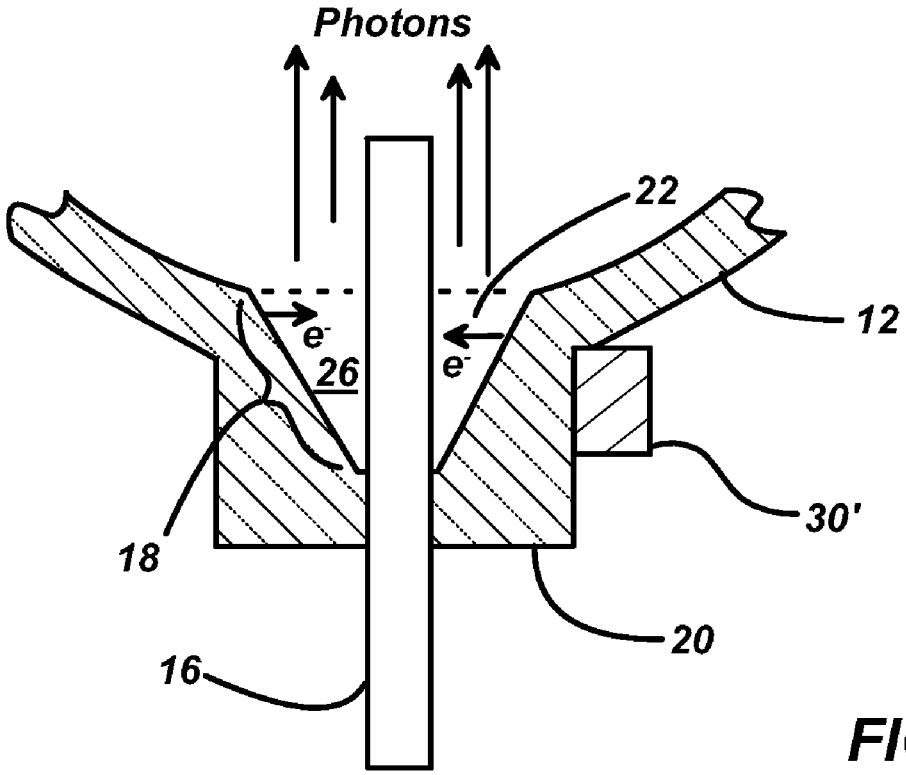
FIG. 3 is an illustration of an alternate embodiment of the invention.

In a preferred embodiment, the secondary cathode 30 is a ring around the first region of the vessel. The secondary cathode may also be a rod (shown as 30' in FIG. 3). The ring extends the area from which the initiating electrons for the DBD can be taken as compared to a rod. Tests have shown that a starting voltage for a typical HID lamp can be reduced from 18-25 kV (without the starting aid) to 9-10 kV with the rod embodiment 30' and to about 8 kV with the ring embodiment.

While embodiments of the present invention have been described in the foregoing specification and drawings, it is to be understood that the present invention is defined by the following claims when read in light of the specification and drawings.

We claim:

1. A high-intensity discharge lamp comprising:

a discharge vessel made of an insulator;

a cathode attached to one end of the vessel and an anode attached to an opposite end of the vessel, the vessel having a first region directly adjacent to where the anode separates from an interior surface of the vessel, the first region and the anode defining a V-shaped gap between the anode and the interior surface of the vessel, the gap is filled with a gas and opens to a discharge chamber of the vessel, the first region having an unimpeded line-of-sight to the cathode; and a secondary cathode positioned on an exterior surface of the vessel at the first region so that the gap and first region are between the secondary cathode and the anode, the secondary cathode being connected to the cathode and generating an electric field at the first region that produces a dielectric barrier discharge in the gap, the dielectric barrier discharge generating UV and VUV photons which impinge on the cathode and initiate a breakdown between the cathode and the anode.

2. The lamp of claim 1, wherein the secondary cathode is a ring around the first region of the vessel.

3. The lamp of claim 1, wherein the secondary cathode is a rod.

4. The lamp of claim 1, wherein the gas comprises xenon or argon.

5. A method of igniting a high-intensity discharge lamp, the lamp including a discharge vessel made of an insulator, and a cathode attached to one end of the vessel and an anode attached to an opposite end of the vessel, the method comprising the steps of:

providing a V-shaped gap between the anode and a first region of the vessel directly adjacent to where the anode separates from an interior surface of the vessel, the gap being filled with a gas and opening to a discharge chamber of the vessel, the first region having an unimpeded line-of-sight to the cathode;

providing a secondary cathode on an exterior surface of the vessel at the first region, the secondary cathode being positioned so that the gap and the first region are between the secondary cathode and the anode, the secondary cathode being connected to the cathode;

applying an electric field between the anode and the secondary cathode to form a dielectric barrier discharge in the gap, the dielectric barrier discharge generating a pulse of UV and VUV photons which impinge on the cathode to initiate a breakdown between the cathode and anode.

6. The method of claim 5, wherein the pulse of photons starts 50-100 ns after applying a voltage to the cathode and lasts up to a few microseconds.

7. The method of claim 5, wherein the photons have a wavelength in the ultraviolet (UV) or vacuum ultraviolet (VUV).

8. The method of claim 5, wherein the secondary cathode is provided as a ring around the first region of the vessel.

9. The method of claim 5, wherein the secondary cathode is provided as a rod.

10. The method of claim 5, wherein the gas comprises xenon or argon.

* * * * *